US005737776A

United States Patent [19]

Jennings

[11] Patent Number: 5,737,776

[45] Date of Patent: Apr. 14, 1998

[54] NON-SLIP PANTYHOSE

[76] Inventor: Lynne M. Jennings, 2400 Feather Sound Dr. #112, Clearwater, Fla. 33762

[21] Appl. No.: 753,000

[22] Filed: Nov. 21, 1996

[51] Int. Cl.[6] ..... A41B 11/04

[52] U.S. Cl. ..... 2/409; 2/239

[58] Field of Search ..... 2/409, 239, 83, 2/1, 69

[56] References Cited

U.S. PATENT DOCUMENTS

| | | | |
|---|---|---|---|
| 832,550 | 10/1906 | Lepper | 2/239 |
| 1,597,934 | 8/1926 | Stimpson | 2/239 |
| 1,659,171 | 2/1928 | Spafford | 2/239 |
| 2,725,567 | 12/1955 | Bevier | 2/83 |
| 2,771,691 | 11/1956 | Luchs | 2/239 |
| 3,863,272 | 2/1975 | Guille | 2/239 |
| 4,021,860 | 5/1977 | Swallow et al. | 2/239 |
| 4,069,515 | 1/1978 | Swallow et al. | 2/239 |
| 4,149,274 | 4/1979 | Garrou et al. | 2/239 |
| 4,651,354 | 3/1987 | Petrey | 2/239 |

FOREIGN PATENT DOCUMENTS

| | | | |
|---|---|---|---|
| 955048 | 4/1964 | United Kingdom | 2/409 |

*Primary Examiner*—Gloria Hale
*Attorney, Agent, or Firm*—American Innovations Inc.

[57] ABSTRACT

Multi layer foot pads attached to the sole portions of pantyhose for placement against the soles of a wearer's feet, the foot pads comprising an outer gripping layer and an inner layer which functions to keep moisture away from the wearer's feet. In the preferred embodiment the inner layer comprises moisture absorbing material, as well as material adjacent to the wearer's feet for wicking moisture away therefrom and into the moisture absorbing material. Applications may include, but are not limited to, use for increasing the comfort of a wearer by keeping the wearer's feet dry and securely positioned within a shoe, use in eliminating the common and irritating problem of conventional foot pads bunching and wrinkling inside a pair of shoes, as well as eliminating the common problem of the foot portion of pantyhose slipping inside a pair of shoes.

9 Claims, 4 Drawing Sheets

NON-SLIP PANTYHOSE

BACKGROUND—FIELD OF INVENTION

This invention relates to stockings, specifically to improved pantyhose having multi-layer foot pads attached thereto for placement against the soles of a wearer's feet, the foot pads comprising an outer gripping layer and an inner layer which functions to keep moisture away from the wearer's skin. In the preferred embodiment it is contemplated for the inner layer to comprise a combination of moisture absorbing material and material adjacent to the wearer's feet for wicking moisture away therefrom and into the moisture absorbing material. Applications may include, but are not limited to, use for increasing the comfort of a wearer by keeping the wearer's feet dry and securely positioned within a shoe, use in eliminating the common and irritating problem of conventional foot pads bunching and wrinkling inside a pair of shoes, as well as eliminating the common problem of the foot portion of pantyhose slipping inside a pair of shoes.

BACKGROUND—DESCRIPTION OF PRIOR ART

Pantyhose are widely accepted and used. They are available in many different sizes and stretchable fiber compositions. One problem attributable to pantyhose is that they can make some people's feet perspire, moist feet being undesirably susceptible to fungus infections, odors, and other problems, the perspiration also causing slippage in the wearer's shoes. To solve this problem, some people use foot pads, or insoles, in their shoes. However, foot pads and insoles do not always stay positioned within a shoe and can become bunched and wrinkled during use. Also, when new, most correctly sized pantyhose will fit snugly and the stretchable fibers from which they are made will have sufficient memory to cause the pantyhose to stay in position during use. However, when repeatedly worn, as well as after repeated washings, pantyhose fibers can loosen resulting in pantyhose that will slip inside a wearer's shoes. Wrinkles caused by such slipping can create irritated areas on a wearer's feet. As a result, it would be useful, and it is not known, to have improved pantyhose with a foot pad attached to the sole portion of each of its feet to draw moisture away from a wearer's foot, to reduce slipping of the wearer's foot within the shoes, and to keep the foot pad securely positioned.

It is known to have combination height increasers, heel cushions and stocking protectors, such as the invention disclosed in U.S. Pat. No. 898,120 to Litch (1908). The Litch invention has an upper portion made from calf skin, sheep skin, or chamois, the upper portion being connected to a sole portion, with a cushion portion of felt, rubber or cork being cemented to the inner surface of the sole portion. Elastic webbing fastened to each side of the upper portion holds the Litch invention against a wearer's ankle during use. It is also disclosed in U.S. Pat. No. 4,870,708 to Staley (1989) to have an undergarment with pants, leg coverings and socks, wherein the socks are reinforced and knitted continuously with the leg portions. Further, U.S. Pat. No. 1,659,171 to Spafford, (1928) discloses a sandal adapted for wearing inside a conventional stocking or sock for relief of the arches of a foot. The Spafford invention comprises a pocket therein for adding layers of material to build up the arch of the sandal. It is also contemplated for lightweight embodiments of the Spafford invention to be made from silk, cotton, or wool for golfers and walkers. In contrast to the Litch, Staley, and Spafford inventions, the present invention comprises a multi-layered foot pad stitched to the sole portion of a conventional pair of pantyhose.

The prior art thought to be most closely related to the present invention are the inventions disclosed in U.S. Pat. No. 4,506,392 to White (1985) and U.S. Pat. No. 832,550 to Lepper (1906). The White invention comprises an athletic undergarment with its legs and trunk portions woven from sheer, resilient, elastic fibers, and with its foot portions made from knitted, heavy, compressible yarn which is stitched to the leg and trunk portions. The foot portions prevent slippage and excessive perspiration build-up, while the elastic trunk and leg portions provide muscular support and circulatory stimulation. The present invention can be distinguished from the White invention since the foot pad of the present invention is multi-layered and it covers only the sole of a wearer's foot. The Lepper invention comprises a combined insole and retaining device for the purpose of keeping a wearer's feet warm and dry, while also providing cushioning against the formation of corns and calluses. The Lepper invention covers the sole of a foot, as well as the perimeter of the upper portion of a wearer's foot. The Lepper invention can be worn without hose, inside hose, or outside hose, but is not connected directly to the hose. It is also contemplated for the Lepper invention to have small pads for the protection of corns on the wearer's feet that are stitched to selected sites on the inside surface of the Lepper invention for use in protecting irritated areas of a wearer's foot. In contrast to the present invention, the Lepper invention does not have two layers substantially similar in size positioned adjacent to one another and attached to the soles of pantyhose feet to keep moisture away from the wearer's skin. It is not known in this field to have improved pantyhose having multi-layer foot pads attached thereto for placement against the soles of a wearer's feet, the foot pads comprising an outer gripping layer and an inner layer made from moisture absorbing material and material place adjacent to the wearer's feet for wicking moisture away therefrom and into the moisture absorbing material.

SUMMARY OF INVENTION—OBJECTS AND ADVANTAGES

It is the primary object of this invention to provide improved pantyhose having a multi-layered foot pad which both wicks moisture away from a wearer's feet, and prevents slipping of the wearer's foot within a pair of shoes. A further object of this invention is to provide improved pantyhose wherein the improvement is limited to the soles of the pantyhose feet. It is also an object of this invention to provide improved pantyhose wherein the improvement is attached directly to the material of the pantyhose by stitching. A further object of this invention is to provide improved pantyhose which eliminates the need for conventional foot pads or insoles to prevent foot slippage within a shoe and the bunching and wrinkling commonly experienced with such foot pads and insoles.

As described herein, properly manufactured and worn, the present invention would provide improved pantyhose since the gripping outer layer of the foot pads attached to the soles of the pantyhose feet would not slip within a wearer's shoes. The improved pantyhose would also comprise at least one inner layer to keep moisture away from the wearer's skin. In the preferred embodiment, the inner layer would comprise a combination of moisture absorbing material and material positioned adjacent to the wearer's feet which wicks moisture away therefrom and into the moisture absorbing material. It is contemplated for the attached foot pads to be stitched to the soles of the pantyhose and be limited in area to the soles of the pantyhose. In the preferred embodiment, it is contemplated for the outer gripping layer of each foot pad to comprise a rubber material and for one of the inner layers to comprise cotton. Also, since some of the styles of women's shoes are not sturdily made, use of the present invention also will make it more comfortable to wear such shoes.

The description herein provides preferred embodiments of the present invention but should not be construed as limiting the scope of the improved pantyhose invention.

For example, variations in the number of inner moisture absorbing layers used, the type of stitching material used to attach each foot pad to the sole of a pantyhose foot, the stitch configuration used to securely fasten each foot pad to the sole of a pantyhose foot, the type of gripping material used, the type of moisture wicking material used for the upper layer of each foot pad, and the thickness of each layer, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
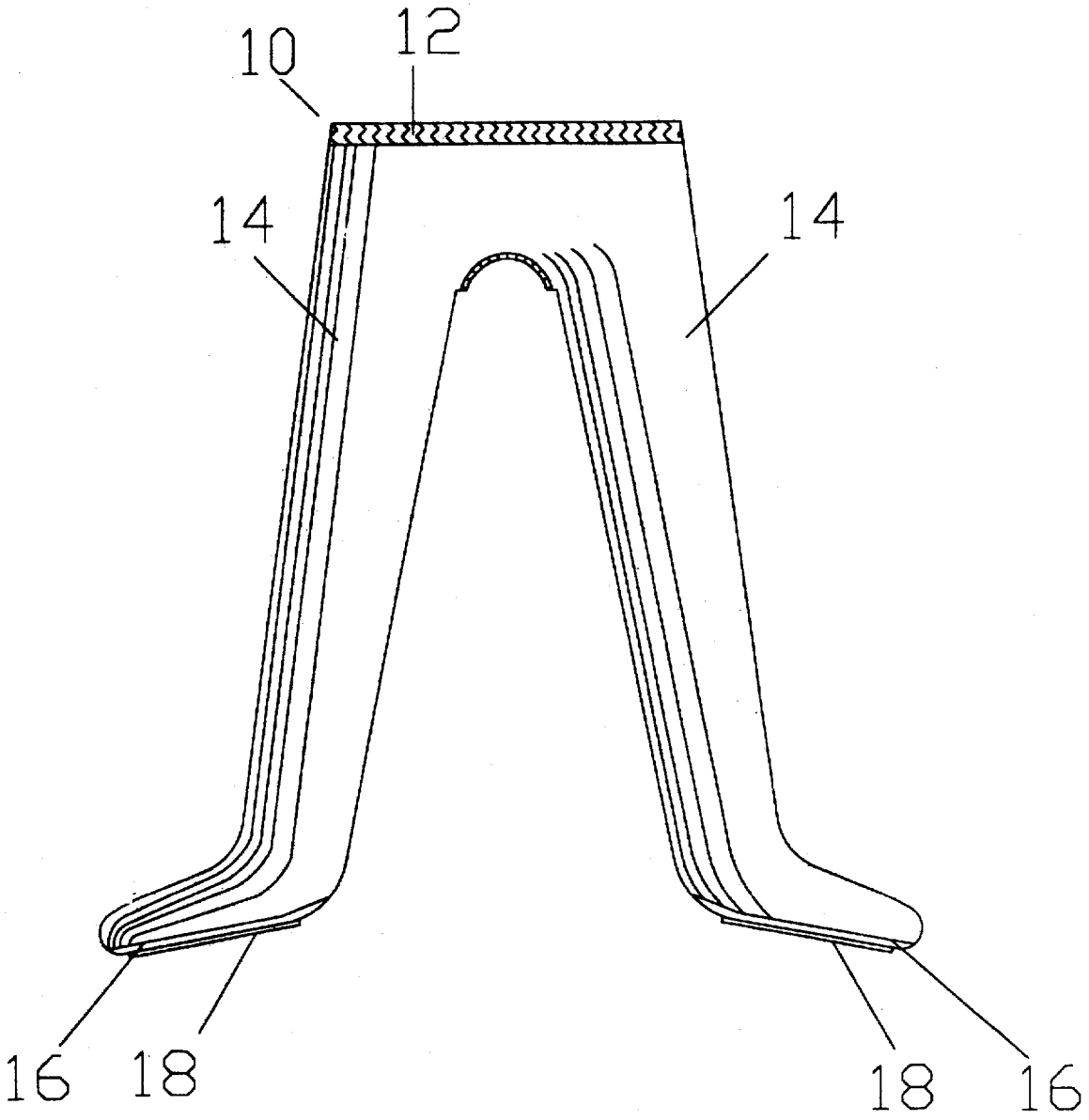
FIG. 1 is a front view of the invention.

FIG. 1 shows a preferred embodiment of an improved pantyhose invention 10 having two footed leg members 14 with an elastic waistband 12 attached to its top portion. Attached to the soles of each leg member 14 is an outer gripping layer 18 and an inner layer 16 positioned between outer gripping layer 18 and the material forming each leg member 14. In the preferred embodiment it is contemplated for outer gripping layer 18 to be made from a rubber material. Although the surface texture of the exposed surface of outer gripping layer 18 is not critical to the present invention, in the preferred embodiment it is contemplated for the surface texture of outer gripping layer 18 to be sufficiently varied so as to prevent slippage of outer gripping layer 18 when placed against the inner surface of a shoe (not shown). In the preferred embodiment it is also contemplated for inner layer 16 to comprise one or more types of material, such as wicking material to reduce moisture next to the skin of a wearer's foot (not shown) material to absorb moisture, the moisture absorbing material being positioned adjacent to outer gripping layer 18.

Figure 2:
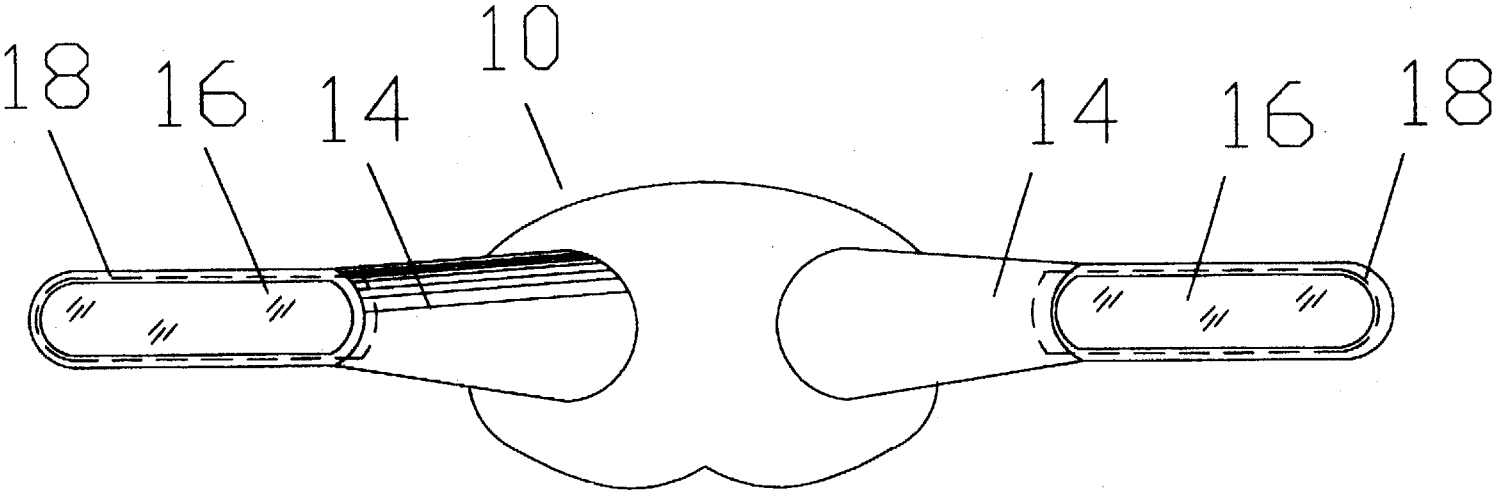
FIG. 2 is a bottom view of the invention.
Figure 3:
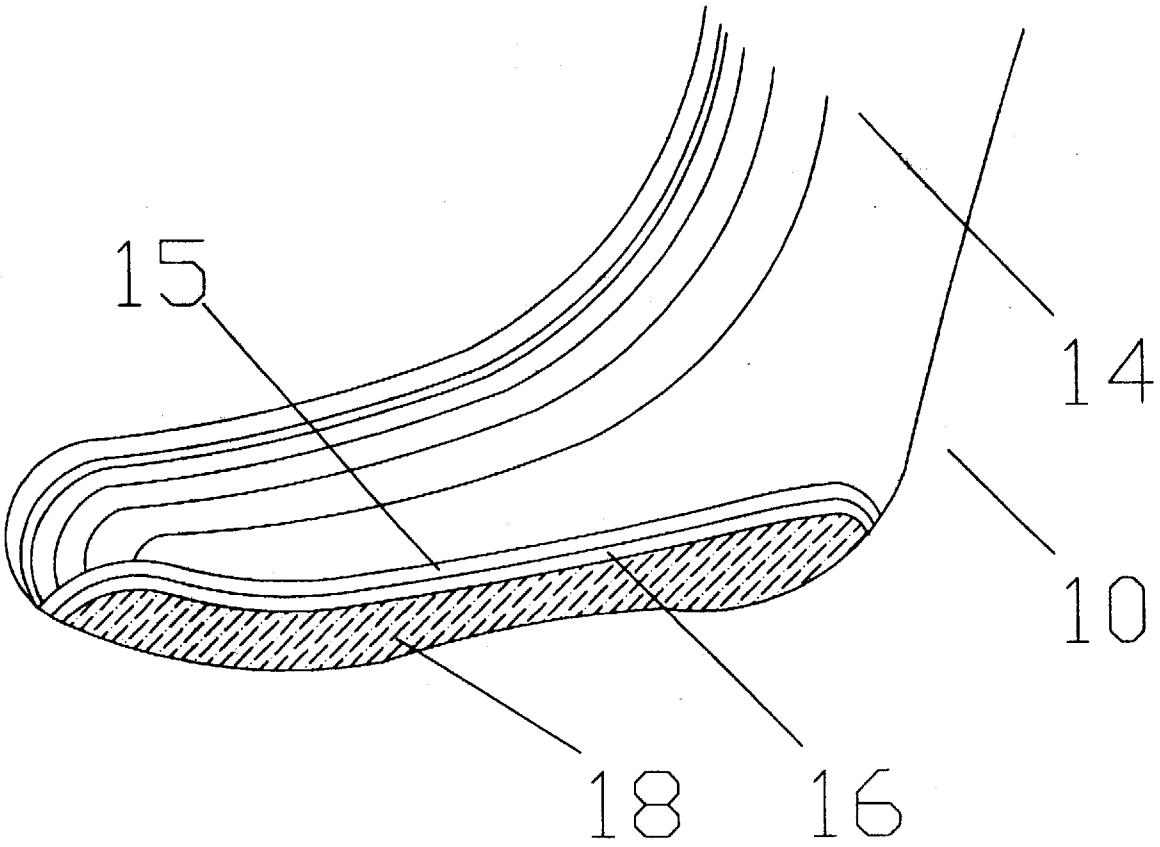
FIG. 3 is a side view of the foot portion of the invention.
Figure 4:
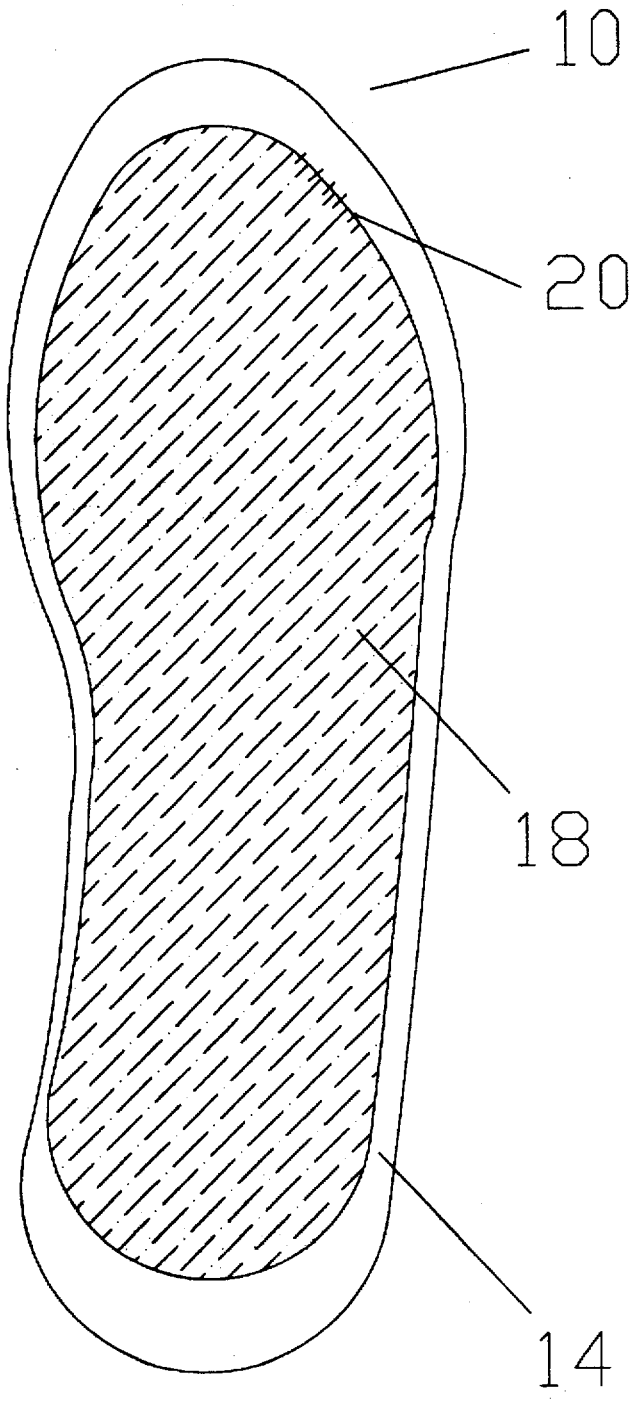
FIG. 4 is a bottom view of the foot portion of the invention.

FIGS. 2 and 3 show improved pantyhose invention 10 having outer gripping layer 18 and inner layer 16 positioned adjacent to the outer surface of leg member 14, with inner layer 16 secured between outer gripping layer 18 and leg member 14. FIG. 4 shows improved pantyhose invention 10 having outer gripping layer 18 attached to leg member 14 with stitching material 20. In the preferred embodiment the type of stitching material 20 used, and the configuration of stitching material 20 after it is applied to bind each outer gripping layer 18 to one leg member 14, are not critical to the present invention. Also not critical to the present invention are the number of inner layers 16 used, the type of non-slip gripping material used, the type of moisture wicking material used in inner layer 16, and the thickness of outer gripping layer 18 and inner layer 16. To use improved pantyhose invention 10, a wearer would put it on as the wearer would put on ordinary pantyhose (not shown), making certain that each inner layer 16 is positioned adjacent to the sole of one of the wearer's feet prior to the wearer placing his or her feet into shoes.

What is claimed is:

1. Multi-layer foot pads used in connection with pantyhose having an elastic waistband attached, two footed leg members downwardly depending therefrom, and each of said leg members having a sole portion, each said foot pad comprising:

an outer gripping layer and an inner layer;

said outer gripping layer comprising non-slip material to prevent said sole portions of said pantyhose from slipping a shoe of a wearer;

said inner layer comprising material which would keep moisture away from the foot of said wearer;

said inner layer being positioned between said outer gripping layer and said sole portion of one of said leg members; and attaching means to position said outer gripping layer and said inner layer adjacent to said sole portion of one of said leg members during use by said wearer.

2. The structure set forth in claim 1 wherein said non-slip material comprises rubber.

3. The structure set forth in claim 1 wherein said inner layer comprises cotton.

4. The structure set forth in claim 1 wherein said outer gripping layer comprises a perimeter and wherein said attaching means comprises a stitching sufficient for connecting said perimeter of each of said outer gripping layers to a different one of said sole portions.

5. The structure set forth in claim 1 wherein said inner layer comprises both moisture absorbing material and moisture wicking material, said moisture absorbing material being positioned between said outer gripping layer and said moisture wicking material.

6. Multi-layer foot pads used in connection with pantyhose having an elastic waistband attached, two footed leg members downwardly depending therefrom, and each of said leg members having a sole portion, each said foot pad comprising:

an outer gripping layer and an inner layer;

said outer gripping layer comprising non-slip material to prevent said sole portions of said pantyhose from slipping a shoe of a wearer;

said inner layer being positioned between said outer gripping layer and said sole portion of one of said leg members;

said inner layer comprising material which would keep moisture away from the foot of said wearer and include both moisture absorbing material and moisture wicking material said moisture absorbing material being positioned between said outer gripping layer and aid moisture wicking material; and attaching means to position said outer gripping layer and said inner layer adjacent to said sole portion of one of said leg members during use by said wearer.

7. The structure set forth in claim 1 wherein said outer gripping layer comprises a perimeter and wherein said attaching means comprises a stitching sufficient for connecting said perimeter of both of said outer gripping layers to one of said sole portions.

8. The structure set forth in claim 7 wherein said non-slip material comprises rubber.

9. The structure set forth in claim 8 wherein said inner layer comprises cotton.

* * * * *